United States Patent [19]

Ambruoso, Sr. et al.

[11] 4,038,502

[45] July 26, 1977

[54] ACOUSTIC COUPLING STRUCTURE FOR MICROPHONE

[75] Inventors: Pasquale Ambruoso, Sr., Coral Springs; Laszlo Szalvay, Fort Lauderdale, both of Fla.

[73] Assignee: Motorola, Inc., Schaumburg, Ill.

[21] Appl. No.: 560,008

[22] Filed: Mar. 19, 1975

[51] Int. Cl.[2] ..... H04R 1/02

[52] U.S. Cl. ..... 179/179; 181/155

[58] Field of Search ..... 179/102, 105, 121 R, 179/138 R, 179, 1 FS, 1 H, 1 HF; 181/148, 149, 155, 156, 160

[56] References Cited

U.S. PATENT DOCUMENTS

| | | | |
|---|---|---|---|
| 1,533,515 | 4/1925 | Reynolds | 179/1 H |
| 1,551,821 | 9/1925 | Graham | 179/121 R |
| 2,518,805 | 8/1950 | Massa | 179/179 |
| 3,210,723 | 10/1965 | Martelli et al. | 179/179 |
| 3,240,883 | 3/1966 | Seeler | 179/138 R |
| 3,651,286 | 3/1972 | Gorike et al. | 179/179 |
| 3,864,531 | 2/1975 | Watson | 179/121 R |

FOREIGN PATENT DOCUMENTS

| | | | |
|---|---|---|---|
| 1,132,430 | 3/1957 | France | 179/1 FS |

*Primary Examiner*—George G. Stellar

*Attorney, Agent, or Firm*—Donald B. Southard; Margaret Marsh Parker; James W. Gillman

[57] ABSTRACT

The microphone of an electronic device is mounted within the housing of the device, and may be a microphone cartridge having a sound opening exposed to a sound chamber within the housing. The device may be a portable radio transmitter and receiver wherein the housing has a wall with a grille screen for providing sound transmission between the inside and the outside of the housing. A cavity is provided inside the housing adjacent the screen for receiving sound to be applied to the microphone. A sound passage connects the cavity to the sound chamber which acts as a reinforcing chamber to apply sound to the microphone. In a radio transmitter and receiver, a loudspeaker may be positioned to project sound through the grille screen, and the cavity between the loudspeaker cone or diaphragm and the screen forms the cavity for collecting the sound. The passage for applying sound to the sound reinforcing chamber may be provided by an opening in the screen and an opening in a felt disc covering the screen which cooperate with a recess in the housing. The acoustic coupling structure can be provided by a sound collecting cavity and passage which are independent of a loudspeaker.

10 Claims, 5 Drawing Figures

ACOUSTIC COUPLING STRUCTURE FOR MICROPHONE

BACKGROUND OF THE INVENTION

Small hand-held radio transmitter and receiver devices are now used in many applications which have a loudspeaker to reproduce received signals and a microphone to translate speech into signals for transmission. Such units are subject to rough usage and there has been a problem in providing a microphone which is suitable for such use and which is protected from damage due to shock and from entry of foreign material. The microphone for such use must be quite small and may be a cartridge with a small input hole which is subject to being clogged by dirt, moisture, or other foreign material.

In such small portable devices, it is desired that a single grille be provided on the front of the housing through which sound produced by received signals is projected, and through which sound to be transmitted is applied to a microphone. Various arrangements have been used, such as the suspension of a microphone in front of a loudspeaker cone, but these have not been entirely satisfactory. It has also been proposed to use a combined loudspeaker microphone transducer, but there have been problems in providing the desired fidelity of operation in the two directions.

SUMMARY OF THE INVENTION

It is an object of the invention to provide an improved microphone mounting and acoustic coupling system for a small portable radio device.

Another object of the invention is to provide an acoustic coupling path and sound chamber for a microphone cartridge, whereby the cartridge is protected from shock and from the entry of foreign material.

A further object is to provide an acoustic coupling structure for a microphone cartridge wherein sound from a grille provided adjacent a loudspeaker is applied through a path to a sound reinforcing chamber coupled to the cartridge which is spaced from the grille.

A still further object of the invention is to provide an acoustic coupling structure for a microphone in a hand-held radio device, wherein the device has a sound collecting chamber therein adjacent a grille provided in a wall of the housing, with sound from the collecting chamber being applied through a passage to a sound reinforcing chamber adjacent the microphone.

The acoustic coupling structure of the invention is used with a portable radio device, such as a hand-held radio transmitter and receiver. Such a device has a housing with a grille through which sound is applied from the loudspeaker of the device. Sound to be transmitted is collected by the cavity within the housing adjacent the grille, and is applied through a passage to a sound reinforcing chamber adjacent the microphone. The microphone may be a cartridge with a small sound receiving opening directed to receive sound from the reinforcing chamber. The microphone cartridge is spaced from the grille so that dust or other foreign material cannot enter the sound opening thereof to clog the same. The sound collecting cavity may be the cavity in front of the cone of the loudspeaker, or another cavity provided within the housing. The sound passage may be provided by openings in the grille and in a felt disc covering the grille, which cooperate with a recess in the housing to connect the sound collecting cavity with the sound reinforcing chamber. This structure applies sound to the microphone with the loudness and clarity required for efficient transmission of the sound by the radio transmitter.

DETAILED DESCRIPTION

Figure 1:
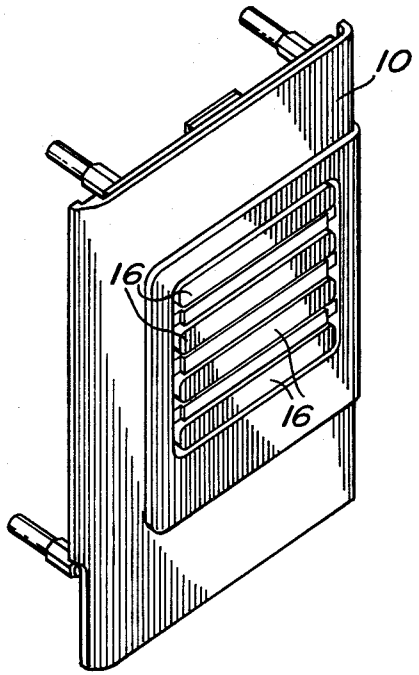
FIG. 1 is a perspective view of the front cover for a radio device including the acoustic structure of the invention.
Figure 2:
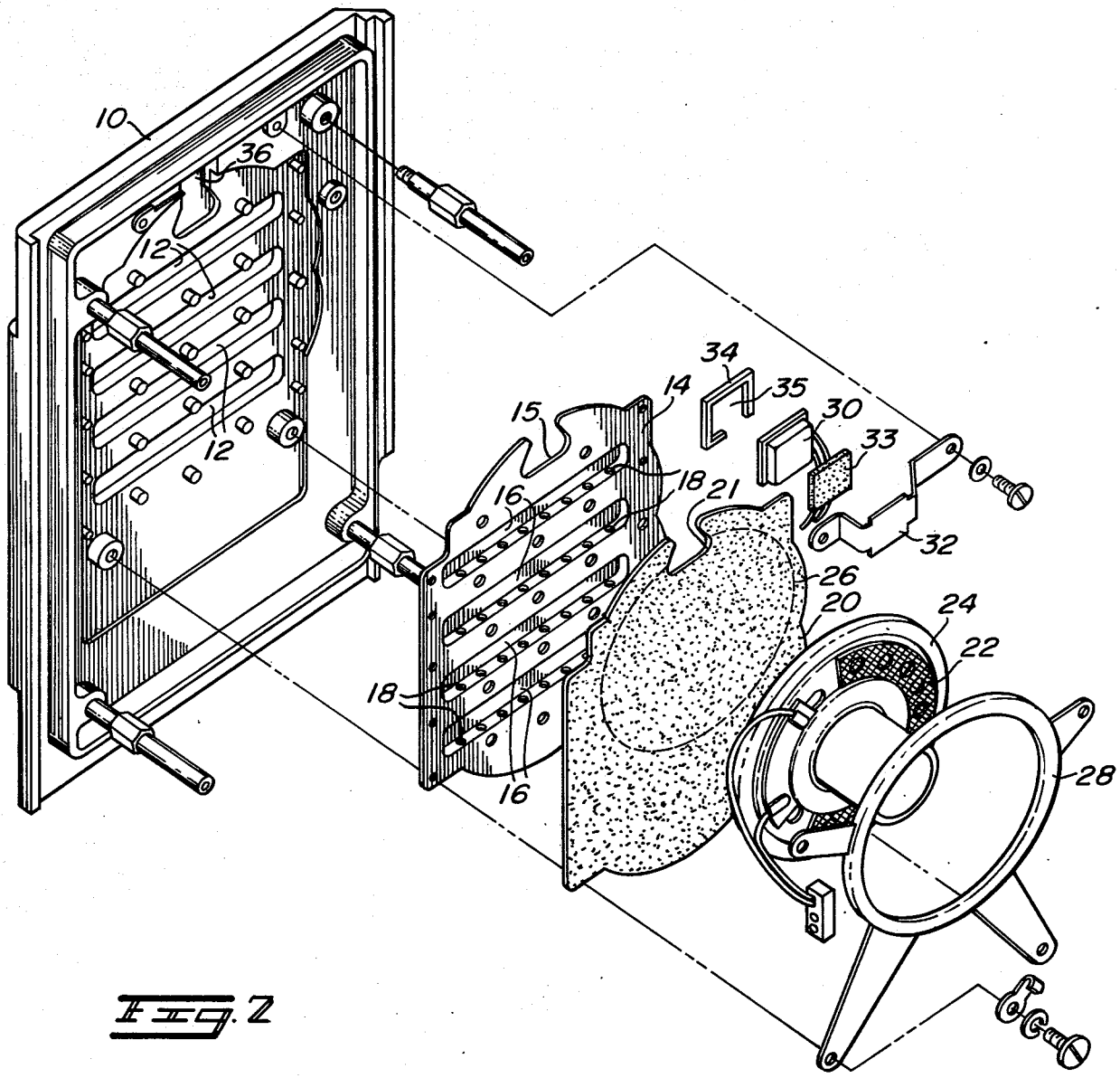
FIG. 2 is an exploded view of the parts providing the acoustic coupling structure.

FIGS. 1 to 4 illustrate the acoustic coupling structure of the invention as utilized in a portable hand-held radio transmitter and receiver. FIG. 1 shows the front cover 10 of the radio housing which includes slots 12 for transfer of sound between the inside and the outside of the housing. Back of the cover 10 is a grille screen 14 having projecting channels 16 which extend into the slots 12 (FIG. 2). The grille screen 14 has openings 18 in the channels thereof (FIG. 4) adjacent the slots 12. This structure is described and claimed in U.S. Pat. No. 3,938,618.

Positioned against the screen 14 is a felt disc 20 which prevents dust and moisture from entering the radio housing. A loudspeaker 22 is positioned against the disc 20, with the rim 24 of the speaker engaging the disc 20 about the dashed line 26 thereon. The speaker 22 is held in place by the annular mounting bracket 28 which is secured to the cover plate 10 by screws.

The microphone cartridge 30, which may be type MM-11 manufactured by Primo Cartridge Company is also secured to the cover plate 10 by bracket 32. A gasket 34 is positioned between the cartridge 30 and the cover plate, and has an open part 35 aligned with a recess 36 in the cover plate. The bracket 32 acts through resilient pad 33 to hold the cartridge 30 against the gasket 34, thereby providing a resilient mounting for the cartridge. The gasket 34 cooperates with the recess 36 and the cartridge 30 to provide a sound chamber 38 (FIGS. 3 and 4) and the cartridge has a sound receiving opening 31 (FIG. 4) in communication with this chamber. As is apparent in FIG. 2, the grille screen 14 has an opening 15, and the felt disc 20 has an opening 21 aligned with the recess 36 in the cover plate 10, to provide a single indirect passage for sound into the sound chamber 38, which passes therefrom through the opening 31 to the electro-acoustic element in the cartridge 30.

Figure 4:
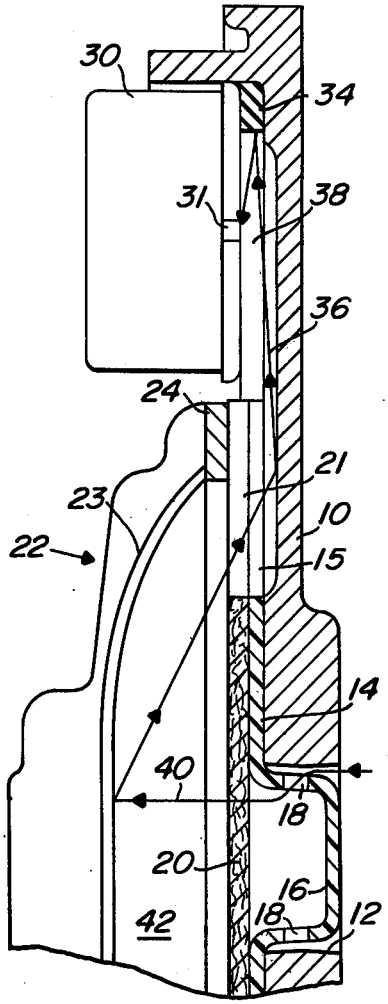
FIG. 4 is a cross-sectional view along the lines 4—4 of FIG. 3.

The operation of the acoustic coupling structure is best illustrated in FIG. 4. Sound from the outside of the radio housing, which is to be transmitted, will enter along the line 40 into the cavity 42 in front of the cone 23 of the loudspeaker 22. This is a relatively large cavity or chamber and will act effectively as a sound collecting chamber. Sound from this chamber will enter the passage formed by the opening 21 in the felt disc 20, the opening 15 in the grille screen 14, and the recess 36 in the cover 10, and is applied to the chamber 38 in front of the cartridge 30. The chamber 38 acts as a sound reinforcing chamber to reinforce the sound so that sound entering the opening 31 in the microphone cartridge 30 has the loudness and clarity to provide an electrical signal for effective radio transmission.

Figure 5:
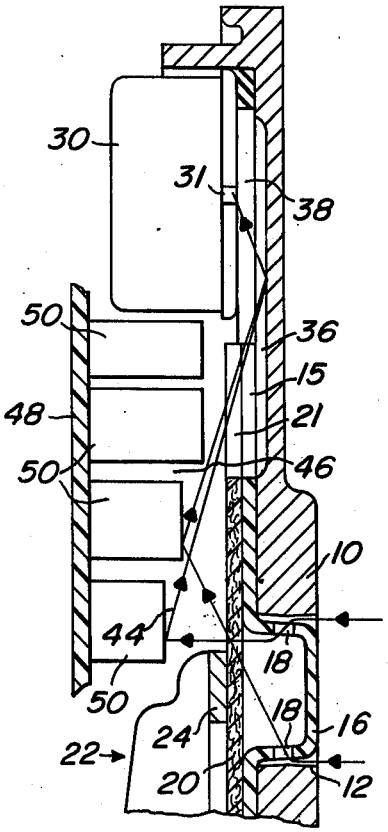
FIG. 5 is a cross-sectional view of a second embodiment of the invention.

FIG. 5 shows an alternate embodiment of the invention. As is apparent from FIG. 3, the loudspeaker 22 can be mounted at a lower position so that the rim 24 thereof is positioned along the dotted line 43, rather than along the dashed line 26. The slots 12 in the cover 10, and the channels 16 in the grille screen 14 cover an area such that sound passages are provided in front of the loudspeaker 22 in both positions. However, when the loudspeaker is in the lower position, there is no passage connecting the cavity in front of the loudspeaker to the sound reinforcing chamber 38. In such case, sound is received through the openings 18 in the grille screen 14, as shown by line 44, and enters a cavity 46 in front of a chassis 48 which has components 50 thereon. Sound from the cavity 46 enters the passage including the opening 21 in felt disc 20, the opening 15 in the grille screen 14, and the recess 36 in the cover plate 10. This sound is applied to the reinforcing chamber 38, and passes to the microphone through the opening 31 in the cartridge 30.

Figure 3:
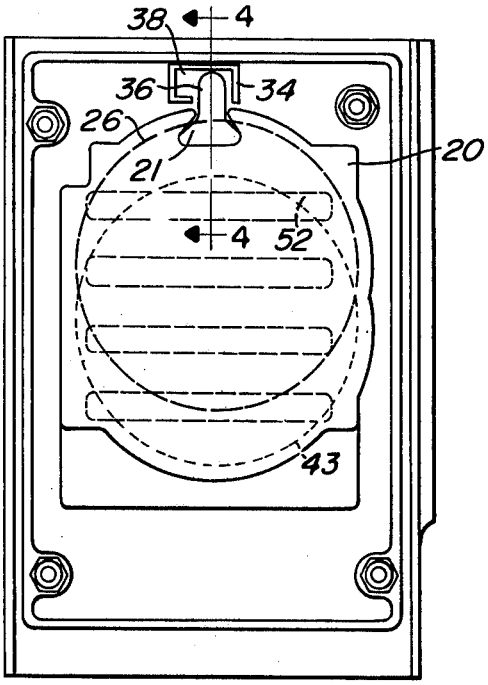
FIG. 3 is a back view of the cover.

The operation of the structure of FIG. 5 is basically the same as in FIG. 4, as sound from the upper part of the grille screen, marked 52 in FIG. 3, enters a cavity which is relatively large and effectively collects the sound. This sound is applied through a short passage to the sound reinforcing chamber 38. The sound from the chamber 38 is applied to the microphone cartridge 30 with loudness and clarity to provide electrical signals which provide effective radio transmission.

The structure of the invention is effective to provide acoustic coupling of sound to a microphone in a small hand-held radio transmitter and receiver. The structure makes it possible to mount the microphone in a position isolated from foreign material which might enter from outside the radio. The microphone is also protected from damage due to shock to which the portable device may be subject. The acoustic system including a sound collecting chamber coupled to a sound reinforcing chamber through a short passage applies sound to the microphone with the loudness and clarity that the microphone can translate the same into electrical signals which are suitable for radio transmission.

We claim:

1. In an electronic device having a housing with a sound transmission portion and electronic components within said housing, the combination including:

a microphone within the housing and supported thereby, said microphone having an electro-acoustic element and a sound receiving opening, a sound reinforcing chamber adjacent said microphone and in communication with said sound receiving opening, a cavity within the housing for receiving sound through the sound transmission portion, and means forming an indirect passage connecting the cavity within the housing to said sound chamber to apply sound received from outside the housing through the indirect passage to said microphone, said passage forming means comprising a portion of the surface of at least one of said electronic components.

2. The structure of claim 1 wherein said means forming a passage includes a portion of the housing which has a recess therein.

3. The structure of claim 1 including a grille screen which cooperates with the housing to form the sound transmission portion, and wherein said grille screen has an opening therein which forms a part of said passage.

4. The structure of claim 1 wherein said microphone includes a cartridge with a sound receiving opening, and wherein said sound reinforcing chamber includes a gasket positioned between said cartridge and the housing.

5. The structure of claim 4 including a bracket for securing said cartridge to the housing, and a resilient pad positioned between said bracket and said cartridge and cooperating with said gasket to provide a shock protecting mounting for said cartridge.

6. The structure of claim 1, further including a loudspeaker in the housing for producing sound in the cavity within the housing, which is passed through the sound transmission portion to the outside of the housing.

7. The structure of claim 6 wherein the sound receiving cavity within the housing is formed by a part of said loudspeaker.

8. In an electronic device having a housing with a sound transmission portion, a loudspeaker in the housing for producing sound within the housing which is passed through the sound transmission portion to the outside of the housing, a grille screen which cooperates with the housing to form the sound transmission portion thereof, and a felt disc over said screen, and wherein said loudspeaker has a cone and a rim engaging said flet disc, with said loudspeaker cone forming a part of the cavity within the housing, the combination including:

a microphone within the housing and supported thereby, said microphone having a sound receiving opening, a sound reinforcing chamber adjacent said microphone and in communication with said sound receiving opening, said cavity within the housing for receiving sound through the sound transmission portion, and means forming a passage connecting the cavity within the housing to said sound chamber to apply sound received from outside the housing through the passage to said microphone.

9. The structure of claim 8 wherein said screen and said disc have openings therein which form a part of said passage for applying sound from the cavity formed by said loudspeaker cone to said sound chamber adjacent said microphone.

10. In an electronic device having a housing with a sound transmission portion, the combination including:

a loudspeaker having a cone;

a microphone within the housing and supported thereby, said microphone having a sound receiving opening, a sound reinforcing chamber adjacent said microphone and in communication with said sound receiving opening, a cavity within the housing for receiving sound through the sound transmission portion, and means forming an indirect passage connecting the cavity within the housing to said sound chamber to apply sound received from outside the housing through the passage to said microphone, said passage forming means including a portion of said loudspeaker cone.

* * * * *